US010264824B2

(12) United States Patent
Weigensberg et al.

(10) Patent No.: US 10,264,824 B2
(45) Date of Patent: Apr. 23, 2019

(54) CARTRIDGE ASSEMBLY FOR AN ELECTRONIC VAPING DEVICE

(71) Applicant: Nu Mark Innovations Ltd., Beit Shemesh (IL)

(72) Inventors: Aaron Arye Weigensberg, Modlin (IL); Eyal Peleg, Tsoran (IL); Samuel Capuano, North Miami Beach, FL (US); Yechezkel Stern, Ramat Bet Shemesh (IL); Bernard Juster, Netanya (IL)

(73) Assignee: Nu Mark Innovations Ltd., Beit Shemesh (IL)

( * ) Notice: Subject to any disclaimer, the term of this patent is extended or adjusted under 35 U.S.C. 154(b) by 0 days.

(21) Appl. No.: 16/164,211

(22) Filed: Oct. 18, 2018

(65) Prior Publication Data

US 2019/0045848 A1 Feb. 14, 2019

Related U.S. Application Data

(63) Continuation of application No. 15/918,440, filed on Mar. 12, 2018, now Pat. No. 10,143,242, which is a continuation of application No. 14/109,393, filed on Dec. 17, 2013, now Pat. No. 9,943,107.

(60) Provisional application No. 61/737,847, filed on Dec. 17, 2012.

(51) Int. Cl.
*A24F 47/00* (2006.01)
*A61M 15/06* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | |
|---|---|---|---|
| 5,388,594 | A | 2/1995 | Counts et al. |
| 5,750,964 | A | 5/1998 | Counts et al. |
| 6,155,268 | A | 12/2000 | Takeuchi |
| 7,381,277 | B2 | 6/2008 | Gonterman et al. |
| 7,726,320 | B2 | 6/2010 | Robinson et al. |
| 9,943,107 | B2 | 4/2018 | Weigensberg et al. |
| 2007/0074734 | A1 | 4/2007 | Braunshteyn et al. |
| 2008/0092912 | A1 | 4/2008 | Robinson et al. |
| 2010/0200006 | A1 | 8/2010 | Robinson et al. |
| 2012/0006346 | A1 | 1/2012 | Inagaki |

(Continued)

FOREIGN PATENT DOCUMENTS

| | | | |
|---|---|---|---|
| CN | 86203578 | U | 3/1987 |
| CN | 101043827 | A | 9/2007 |

(Continued)

OTHER PUBLICATIONS

International Search Report and Written Opinion dated Mar. 27, 2014 for PCT/IL2013/051033.

(Continued)

*Primary Examiner* — Cynthia Szewczyk
(74) *Attorney, Agent, or Firm* — Harness, Dickey & Pierce, P.L.C.

(57) ABSTRACT

An electronic cigarette ("e-Cig") may include flavor enhancements to improve or add to the flavor of an e-Cig. The e-Cig cartomizer may include a flavor sticker, shell, booster, or mouthpiece that provides additional flavor to the user. In addition, the flavor enhancements may also provide or further enhance the smell of the e-Cig.

18 Claims, 8 Drawing Sheets

(56) References Cited

U.S. PATENT DOCUMENTS

| | | | |
|---|---|---|---|
| 2012/0048266 | A1 | 3/2012 | Alelov |
| 2012/0060853 | A1 | 3/2012 | Robinson et al. |
| 2012/0227752 | A1 | 9/2012 | Alelov |
| 2013/0192617 | A1 | 8/2013 | Thompson |
| 2013/0298905 | A1 | 11/2013 | Levin et al. |
| 2013/0319440 | A1 | 12/2013 | Capuano |
| 2018/0199632 | A1 | 7/2018 | Weigensberg et al. |

FOREIGN PATENT DOCUMENTS

| | | | |
|---|---|---|---|
| CN | 200983833 | Y | 12/2007 |
| CN | 201127285 | Y | 10/2008 |
| CN | 101557728 | A | 10/2009 |
| CN | 102014677 | A | 4/2011 |
| EP | 1736065 | A1 | 12/2006 |
| WO | WO-2012/142293 | A2 | 10/2012 |

OTHER PUBLICATIONS

European Search Report dated Jul. 24, 2015 issued in corresponding European Patent Application No. 13819082.2.

Kazakhstan Office Action dated Nov. 7, 2016 issued in corresponding Kazakhstan Application No. 2015/0849.1.

Chinese Office Action dated Dec. 27, 2016 issued in corresponding Chinese Patent Application No. 201380066163.3 (English translation provided).

Office Action for corresponding Russian Application No. 2015129125 dated Mar. 27, 2017 and English translation thereof.

Chinese Office Action dated Jun. 16, 2017 issued in corresponding Chinese Application No. 201380066163.3 (English translation provided).

Chinese Office Action dated Dec. 8, 2017 in Chinese Application No. 201380066163.3, with English translation.

Ukraine Office Action dated Nov. 29, 2017 in Ukrainian Application No. 29806/3A/17.

Malaysian Examination Report dated Mar. 30, 2018 issued in corresponding Malaysian Application No. PI 2015001554.

Chinese Office Action dated Jun. 15, 2018 issued in Chinese Application No. 201380066163.3 (English translation provided).

Examination Report from the European Patent Office for EP Appl. No. 13 819 082.2 dated Sep. 6, 2018.

Figure 8
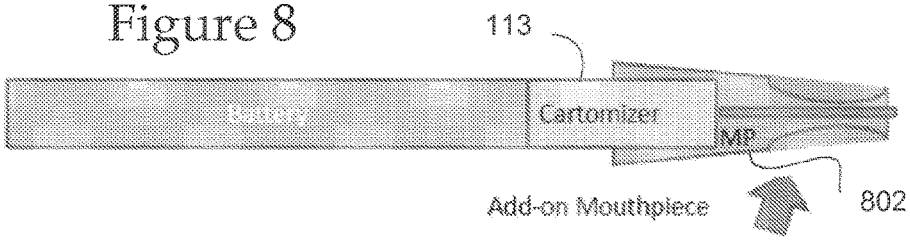
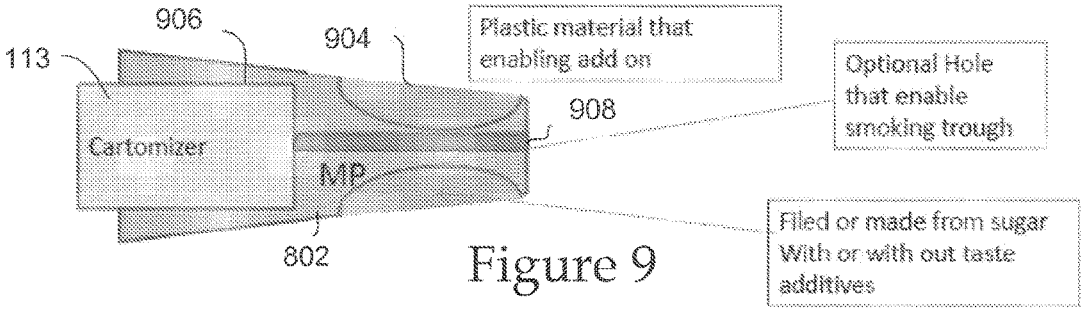
Figure 9
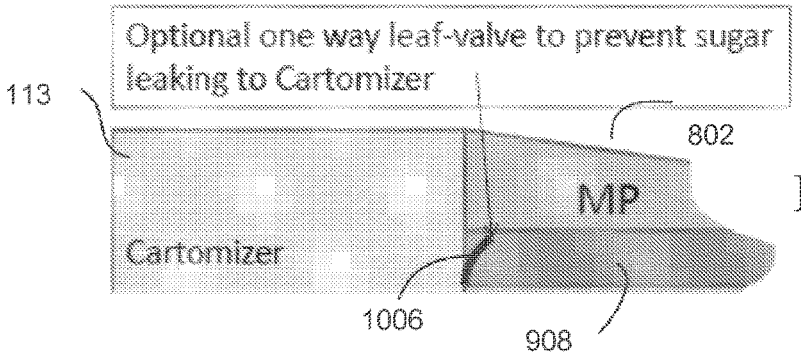
Figure 10

CARTRIDGE ASSEMBLY FOR AN ELECTRONIC VAPING DEVICE

PRIORITY CLAIM

This application is a continuation application of U.S. application Ser. No. 15/918,440, filed on Mar. 12, 2018, which is a continuation of U.S. application Ser. No. 14/109,393, filed on Dec. 17, 2013, which claims priority to U.S. Provisional Application No. 61/737,847, filed on Dec. 17, 2012, entitled "Cartomizer Flavor Enhancement," the entire disclosure of each of which are hereby incorporated by reference.

FIELD

This disclosure generally relates to improvements to an electronic cigarette ("e-cigarette," "e-Cig," or "eCig"). In particular, this disclosure relates to enhancing the flavor and smell as part of the e-Cig experience.

BACKGROUND

An electronic cigarette ("e-cigarette," "e-Cig," or "eCig") is a device that emulates tobacco cigarette smoking, by producing smoke replacement that may be similar in its physical sensation, general appearance, and sometimes flavor (i.e., with tobacco fragrance, menthol taste, added nicotine etc.). A battery portion of the e-Cig includes a controller and rechargeable battery for powering the device (e.g. providing electrical power) and a cartomizer portion generates an aerosol mist (i.e. e-smoke or vapor) that is a replacement for cigarette smoke. In particular, the cartomizer may use heat, ultrasonic energy, or other means to atomize/vaporize a material, such as a liquid solution (i.e. an "e-Liquid"), which may be based on propylene glycol, or glycerin, and may include taste and fragrance ingredients. The result is an aerosol mist. The atomization may be similar to nebulizer or humidifier vaporizing solutions for inhalation.

The e-Liquid may be kept in a container (sometimes called "cartomizer", which may be the approximate size of a regular cigarette's filter), and during the puff some of it is heated while being close to and around a heating coil (for example operated by a battery, and controlled via a control chip and a puff sensor). The heated e-Liquid loses its high viscosity, and then is prone to atomization and some evaporation, generating the "smoke" to be inhaled by the user. The atomization may be enhanced by the usage of an e-Liquid-soaked wick inside a heating coil, where the small spaces between the wick fibers and inside them enhance the breaking of the heated e-Liquid to small droplets generating the fog-like smoke. Some of the vaporized e-liquid may re-condensate to droplets, creating more fog-like smoke, due to the mix of the inhaled room-temperature air with the heated air and vapor inside the cartomizer. This effect is enhanced by the higher temperature generated by the electrically-energized heated coil, combined with the air flow (that reduces pressure around the wick due to the Bernoulli's principle, thus enhancing evaporation rate) both enhance evaporation rate, loading the air around the heating coil and wick combination with e-Liquid vapors. When this air, saturated with e-Liquid vapors, is hit by the room-temperature air flow sucked in by the user, some of its vapor may condensate into small air-borne droplets (similar to water fog in air) and add to the "smoke" generated by the e-Cig.

BRIEF DESCRIPTION OF THE DRAWINGS

The system and method may be better understood with reference to the following drawings and description. Non-limiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views.

FIG. 8 is an exemplary mouthpiece embodiment for flavor enhancement.

FIG. 9 is an exploded view of an exemplary mouthpiece embodiment for flavor

FIG. 10 is an alternative exemplary mouthpiece embodiment for flavor enhancement.

DETAILED DESCRIPTION OF THE INVENTION

Figure 1:
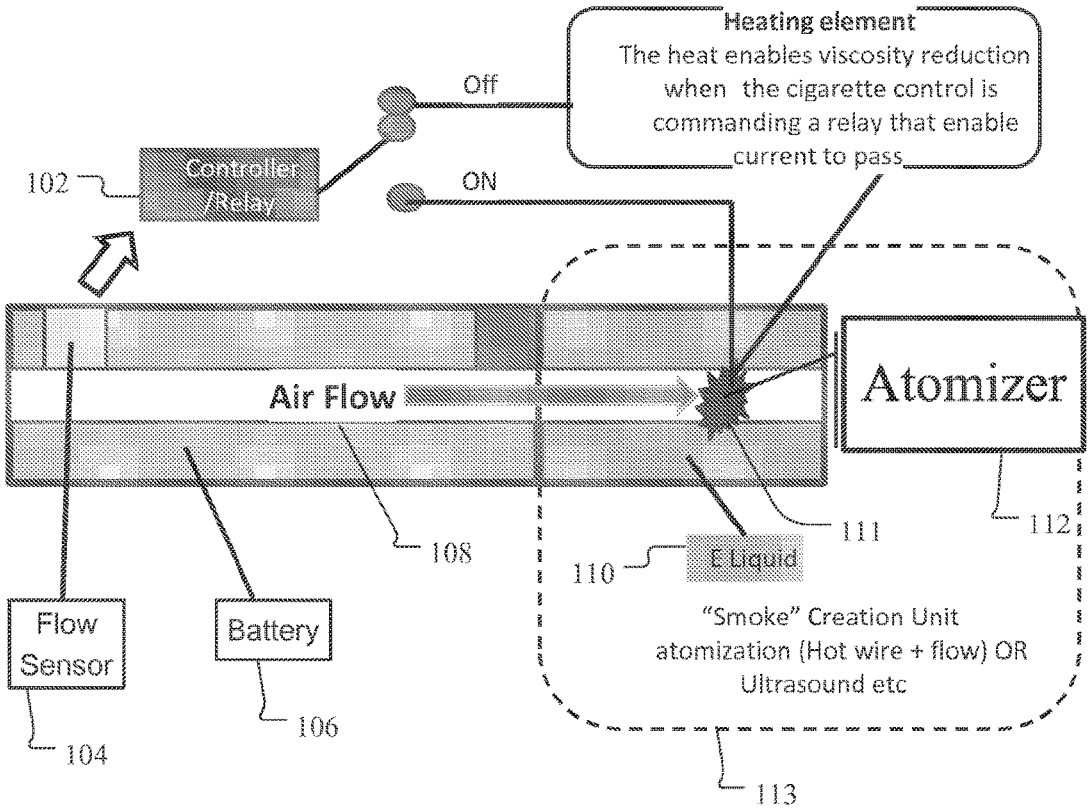
FIG. 1 is a diagram of an electronic cigarette.

The e-Cig may include a battery portion that includes the battery and controller and a cartridge which includes the cartomizer and where atomization occurs. The cartridge may need to receive power from the battery portion for the atomization process. The atomization process generates a vapor or mist from a material (e.g. e-liquid) in the cartomizer that is heated to generate the vapor or mist. The material/liquid may be flavored so that the user can "taste" the flavor. In addition, various flavor enhancements may be made as described below. A sticker or flavor shell may be attached to or adjacent the cartomizer to add flavor for the user. In addition, the sticker or shell may also provide a pleasing smell than enhances the e-Cig experience. In other embodiments, a booster or mouthpiece may be attached to an end of the e-Cig (e.g. adjacent to the cartomizer) for providing additional flavor or a pleasant scent for the user. The flavor and smell enhancement embodiments are described below.

In the following description, numerous specific details are set forth in order to provide a thorough understanding of the various principles of the present invention. It will be apparent to one skilled in the art, however, that not all these details are necessarily always needed for practicing the present invention. Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense. In the following description, numerous specific details are set forth in order to provide a thorough understanding of the various principles of the embodiments. It will be apparent to one skilled in the art, however, that not all these details are necessarily always needed for practicing the embodiments.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

FIG. 1 is a diagram of an e-Cig illustrating two portions. There may be a battery portion and a cartomizer or cartridge 113 portion. Although not shown in FIG. 1, there may be an adapter connecting the two portions. The adapter may be part of the battery portion, part of the cartomizer, or a separate component. The battery portion includes a battery 106. In alternative embodiments, there may be a power source that uses a different mechanism for powering the e-Cig.

The "smoke" produced by an e-Cig is a created by turning a liquid (e-Liquid 110) into mist and some vapor with an atomizer 112. The cartomizer 113 may include the atomizer 112 and the e-liquid 110. The cartomizer 113 may also be referred to as a cartridge throughout this disclosure and may be disposable. The e-liquid 110 may have a high viscosity at room temperature to enable longer shelf life and reduce leakages; however, this high viscosity may reduce the atomization rate. The e-Liquid 110 is atomized via air flow 108, generated by the inhalation of the user (i.e. the smoker or consumer or vapor), which produces a pressure difference that removes e-Liquid droplets from the e-Liquid 110. In one embodiment, the e-Liquid 110 may be soaked in a wick (not shown), which may be connected to a heating element 111. In order to reduce the e-Liquid viscosity, to a level enabling atomization, external heat may be applied through the heating element 111. The heating element 111 may be a coil in one embodiment that wraps around the wick in order to heat the liquid on the wick. In this embodiment, local viscosity reduction via heating, while inhalation occurs, enables e-Liquid atomization in the inhalation-generated flow of air 108. An airflow tube of the battery enclosure and an airflow tube of the cartridge may enable the smoker to puff through the electronic cigarette and activate the airflow sensor inside the battery portion. This may trigger the controller and cause the coil inside the cartridge to get hot, evaporate the liquid that is in the cartridge and causes smoke (i.e. vapor).

The e-Liquid 110 may be heated via an electric current flowing through the heating element 111 and may then be atomized and evaporated through the e-Cig and may contain tastes and aromas that create a smoking sensation. The controller 102 may be activated due to air flow 108 (from the inhaled air) passing a flow sensor 104. The sensor 104 may be activated by the pressure drop across the sensor and may directly switch the battery 106 power on, or be used as an input for the controller 102 that then switches the battery 106 current on. There may be a pressure differential sensor which may be enclosed in a plastic holder and may be part of or separate from the flow sensor 104. Although illustrated as separate from the e-Cig, the controller 102 may be a part of the e-Cig (e.g. along with the battery 106). The battery portion may include one or more electronic chips controlling and communicating from it. It may connect with the cartomizer 113, which can be replaced or changed (e.g. when a new/different e-Liquid 110 is desired). The e-Cig may include two parts. The first part may just be referred to as the battery or battery portion (i.e. battery enclosure) and it includes the power source (e.g. battery), the air flow sensor and the controller. The second part is the cartridge (i.e. cartomizer 113) that is filled up with liquid and flavors that is required for smoke and flavor generation. The configuration of the e-Cig in FIG. 1 is representative of many other forms and variants of electronic cigarettes that may be adapted to embody the principles of the present invention.

Although not explicitly shown in FIG. 1, the e-Cig may include one or more flavor enhancement mechanisms. In particular, the cartomizer 113 may include or be surrounded by a flavor shell or flavor sticker, or a flavor booster may be located adjacent the cartomizer 113. A mouthpiece may also provide flavoring and be attached to the cartomizer 113. A user's lips may contact or be near the end of the cartomizer so the flavor enhancement mechanisms provide additional/enhanced flavors as well as additional/enhanced scents to the user. In other words, the flavor enhancement mechanisms described may provide both gustatory and olfactory enhancements to the e-Cig. The embodiments of the flavor enhancement mechanisms are described in further detail with respect to the other Figures.

In any of the embodiments described below, a flavoring agent or material is added to the e-Cig that provides both flavor/taste and scent/smell. In some embodiments, the flavoring mechanism is added directly to or around the cartomizer or to other parts of the e-Cig. In other embodiments, the flavoring mechanism is provided in a separate component. In one embodiment, the flavoring mechanism may be incorporated in a sticker that wraps around the cartomizer. In another embodiment, the flavoring mechanism may be added to the cartomizer itself. The flavor may be noticeable on the user's lips after using the e-Cig, and via olfactory experience. This provides an enhanced flavor and scent experience for the user.

The flavoring mechanism may be a layer of flavoring that is added to the e-Cig. The layer of flavoring in one embodiment may have a slow release formula and antibacterial preservative properties so that it can be used continuously. The medium holding the flavor and scent may be plastic films with pores or micro-holes, paper, sponge-like films, films with encapsulated taste and scent agents, treated plastic films or any material that can absorb and slow release the scent. The material holding the flavor and scent may be treated to withstand storage and typical use conditions, while preserving its sensory properties and its safety for use. The flavoring/scent agent may include flavors/scents and antimicrobial agents that include carboxymethyl cellulose, pullulan, hydroxypropylmethyl cellulose, hydroxyethyl cellulose, hydroxypropyl cellulose, polyvinyl pyrrolidone, polyvinyl alcohol, sodium alginate, polyethylene glycol, xanthum gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrine, pectin, chitin, chitosan, levan, elsinan, collagen, gelatin, zein, gluten, soy protein isolate, whey protein isolate, casein, and/or mixtures thereof. The flavor may be released from moisture from the lips or air exposure after being unwrapped or removed from packaging, or may be a scratch and sniff material.

Figure 2:
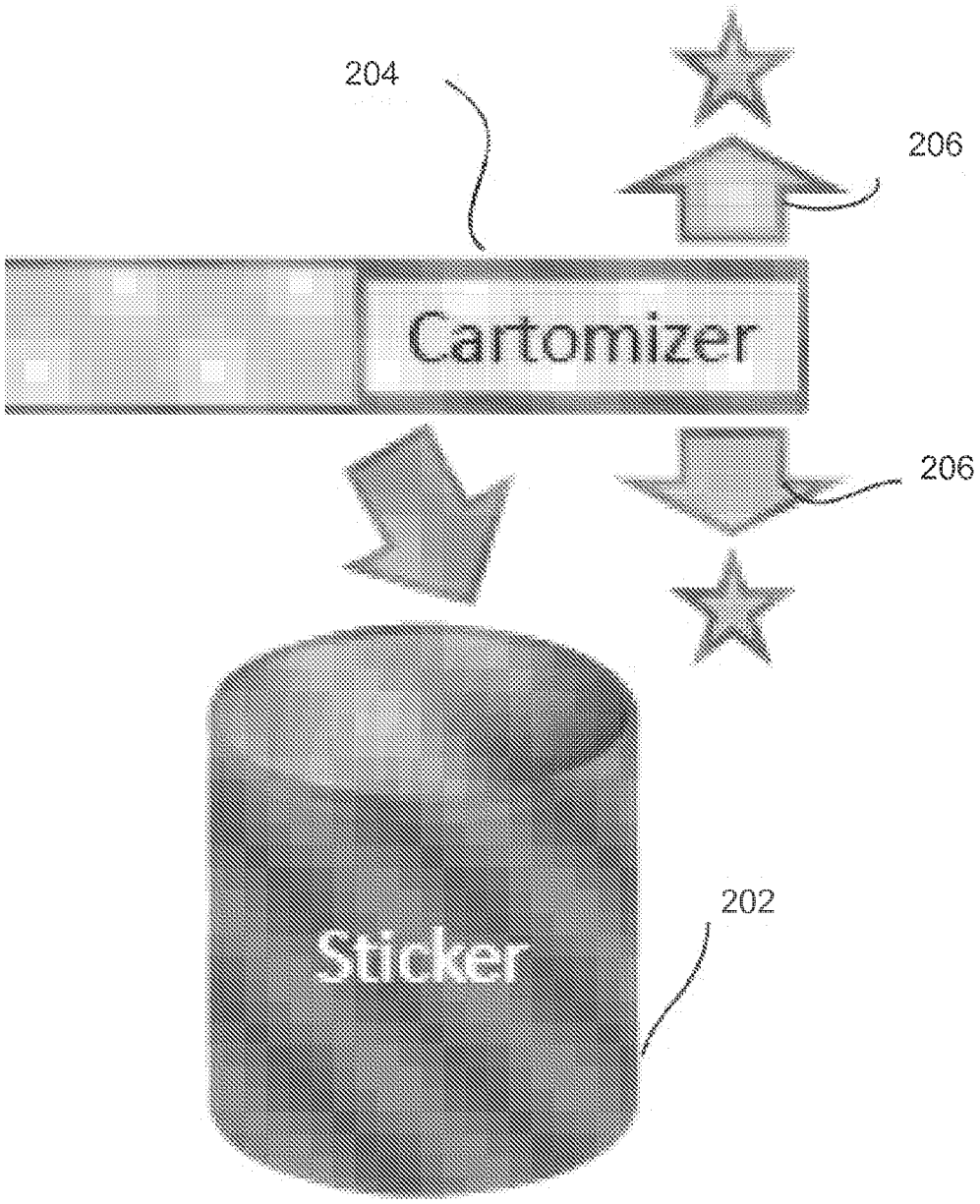
FIG. 2 is an exemplary sticker embodiment for flavor enhancement.

FIG. 2 is an exemplary sticker embodiment for flavor enhancement. FIG. 2 is a schematic of an exemplary cartomizer 113. The cartomizer may be labeled as 113 in each Figure for consistency. However, the cartomizers shown by the different embodiments may not be the same and in particular, may have or be coupled with different flavor enhancement mechanisms. A sticker 202 is impregnated with a flavoring agent, and is adhered to the interior wall 204 of the cartomizer 113, where it is exposed to air flow. Additionally or alternatively, the sticker 202 may be impregnated with a scent agent. The flavoring agent is released, and combines with the air flow, as indicated by air flow 206. In one embodiment, the release of the flavor and/or scent may be triggered by contact with the user's lips. For example, moisture of a user's lips or breath may cause the flavoring agent to be released. The flavoring agent may reach the smoker along with the atomized e-liquid, where it is smelled or tasted, thereby enhancing the enjoyment of the e-Cig.

The flavoring agent may include multiple flavors or scents, e.g., as multiple layers. The sticker 202 may include a binding agent, such as carboxymethylcellulose, which can hold flavoring agents. These agents may release a hint of taste or smell that augments, strengthens, and varies the sensation of the main-liquid. The size of the sticker 202 may vary according to the desired intensity of the flavoring experience, and the concentration of the flavoring agent. Thus, the sticker 202 may cover a selected portion or all of the interior wall 204 of the cartomizer 113. The sticker 202 may be adhered to the inner wall 204 of the cartomizer during manufacture, using conventional materials, such as polyvinyl acetate emulsion. Additionally or alternatively, impregnation by microencapsulated flavoring agents provides a measure of control of the release rate. In one embodiment, the gentle warming of the impregnated material may facilitate release of the flavoring agent into the cartomizer, and to the heating coil where vapor/mist is produced, having an enhanced flavor as a result of the addition of the flavoring agent.

In one embodiment, the cartomizer may be wrapped with one or more soft matte polyethylene terephthalate ("PET") multilayered stickers. In another embodiment, the flavored layer may be applied to the outside of a sticker. In another embodiment, only part of the sticker (e.g., the part that is actually touches the lips of the user is covered with flavoring/scent agent). In one embodiment, the sticker may be a paper material that is coated with a flavoring and/or scent agent.

Figure 3:
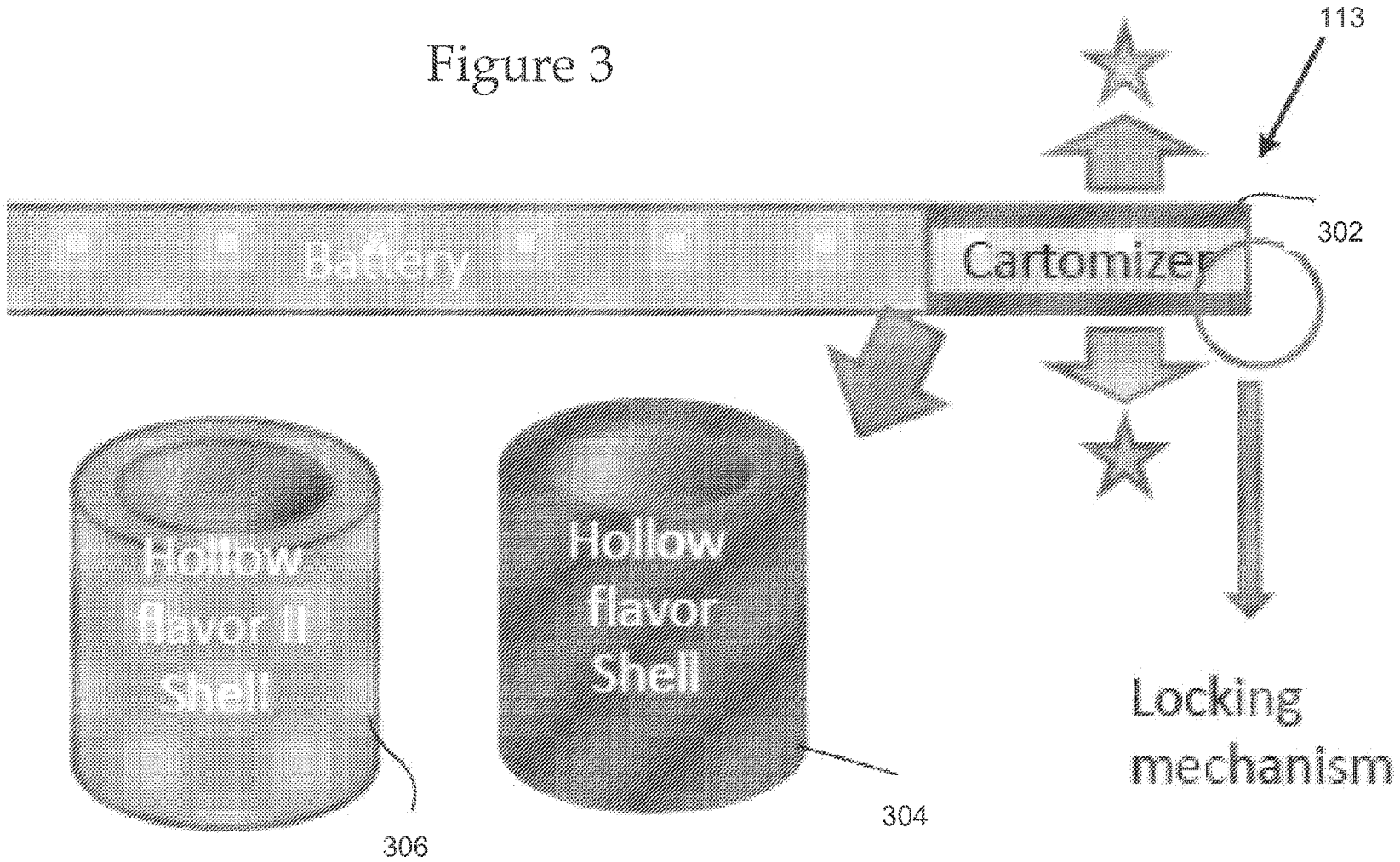
FIG. 3 is a first exemplary shell embodiment for flavor enhancement.

FIG. 3 is a first exemplary shell embodiment for flavor enhancement. FIG. 3 is a schematic view of the cartomizer 113. Rather than a sticker as in FIG. 2, FIG. 3 illustrates one or more flavor shells 304, 306 that are part of or coupled with an inner wall 302 of the cartomizer 113. The one or more flavor shells 304, 306 may include the flavoring agent. For example, the flavor shells 304, 306 may be composed of cellulose acetate or an impregnated sponge, so that they maintain their shape. The flavor shells 304, 306 may extend along the length of interior wall 302 of the cartomizer 113, providing maximum area for release of flavoring agent. Alternatively, the shells 304, 306 may be shorter, and extend along a portion of the wall 302. Varying the length of the shells provides additional control of the amount of flavoring agent released into the gas stream during smoking of the electronic cigarette. Additionally or alternatively, a substance such as impregnated filter plug paper may be applied to the internal surface of the shells 304, 306. The shells 304, 306 may be impregnated with different concentrations of a given flavoring agent, or different flavoring agents. The release capability of the impregnated material may be slow, and may be configured to the expected life of the cartomizer.

Selected ones of the shells 304, 306 may be inserted to the end of the cartomizer 113 during manufacture, and a locking mechanism may be provided to retain the inserted shell. In one example, the locking mechanism may be an adhesive or a glue. Alternatively, the lock may be mechanical, such as a retaining ring or flange, screw. In some embodiments, the mechanism may be unlocked in order to permit replacement of the shells 304, 306. Providing a selection of different shells and flavoring agents facilitates tailoring the cartomizer 113 according to the needs of different consumers. In one embodiment, the shells 304, 306 may be a porous plastic material, such as food graded plastics. The material may have a controlled release material with known permeability. Exemplary materials may include polyurethane, polyethylene, vinyl acetate, or polycarbonate. The materials described above for the shells may also apply to any of the other embodiments, including the sticker, booster, mouthpiece, etc.

Figure 4:
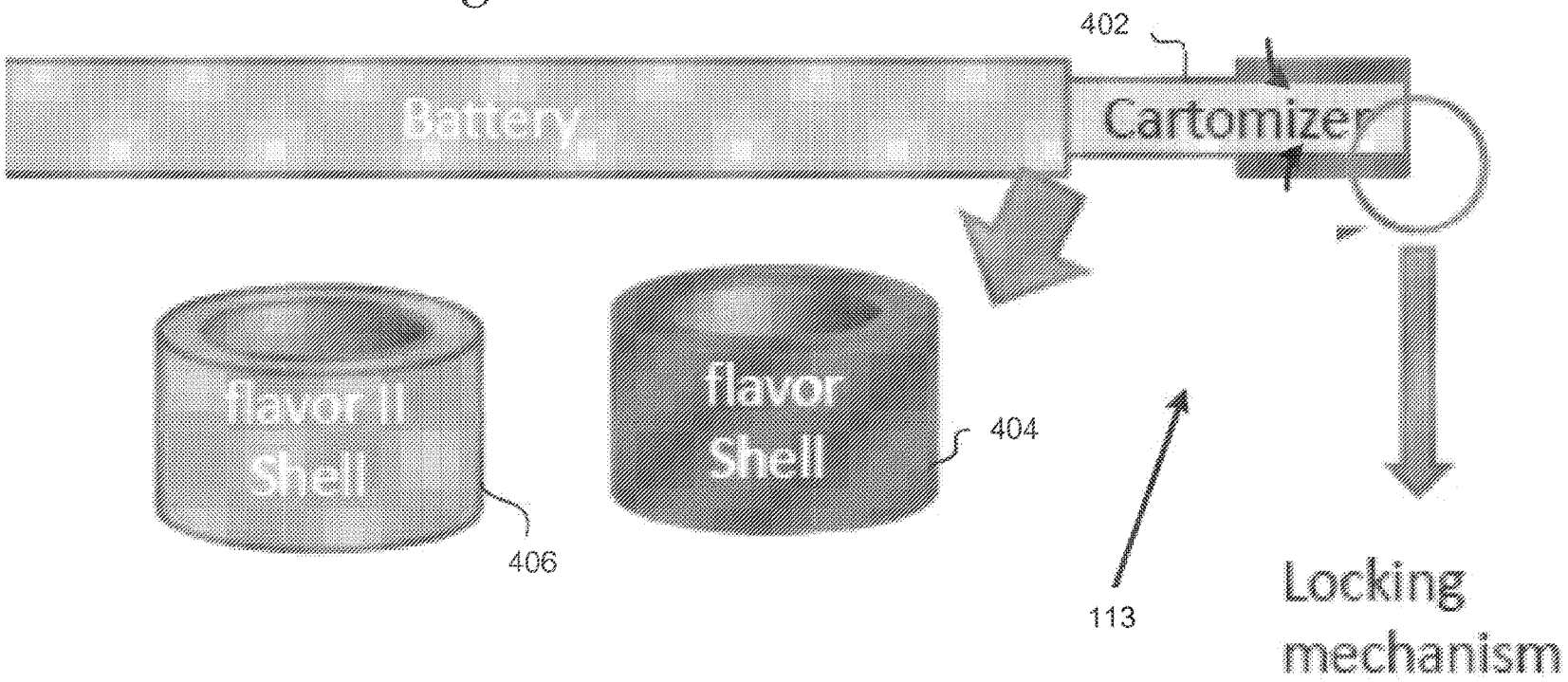
FIG. 4 is a second exemplary shell embodiment for flavor enhancement

FIG. 4 is a second exemplary shell embodiment for flavor enhancement. FIG. 4 is an alternative embodiment with one more flavor shells 404, 406. The exterior wall 402 of the cartomizer 113 is not entirely covered by one or more of the shells 404, 406. In other words, the shell does not extend the length of the cartomizer 113 as compared with the embodiment shown in FIG. 3. Further, in this embodiment, the shells may be mounted on the exterior of wall 402 of the cartomizer 113, and release flavoring agent through the wall 402. The wall 402 may be micro-fenestrated beneath the shells 404, 406, for example having holes of approximately 0.1-0.5 millimeters formed therethrough. Alternatively, the wall 402 may be formed of a permeable material that allows the flavoring agent in the shells 404, 406 to diffuse into the air stream in the interior of the cartomizer. For example, portions of the wall may comprise a membrane of polytetrafluoroethylene or polyurethane. The shells 404, 406 may be dimensioned to fit about the barrel of the cartomizer 113.

A locking mechanism (as with FIG. 3) may prevent the shells 404, 406 from dislodgement.

Figure 5:
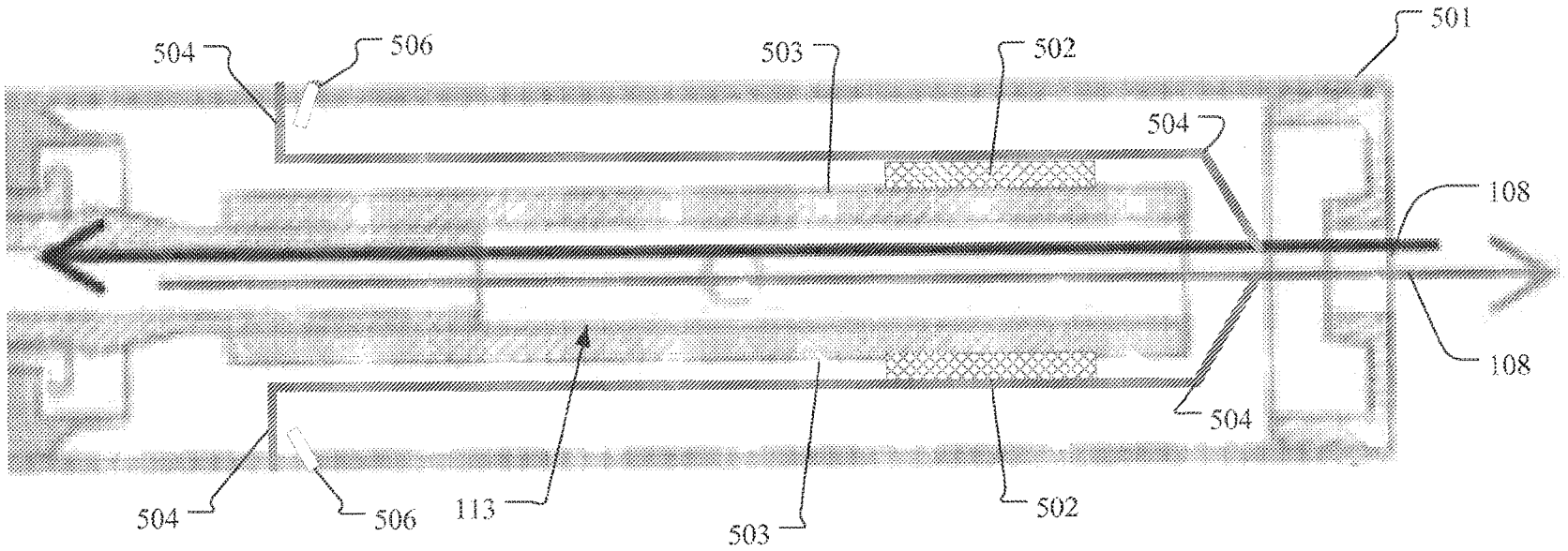
FIG. 5 is an exemplary flavor mechanism embedded within a cartomizer.

FIG. 5 is an exemplary flavor mechanism embedded within a cartomizer 113. FIG. 5 is a partial schematic view where the battery portion would be to the left of the cartomizer 113 portion shown in FIG. 5. A flavor enhancement element 502 is disposed on an exterior wall 503 of the cartomizer 113. In one embodiment, there may be a single flavor enhancement element 502 or there may be more than one such as is shown in FIG. 5. The flavor enhancement element 502 may be a sticker (e.g. 202 in FIG. 2) or shells (e.g. 304, 306, 404, 406 in FIGS. 3-4). The main inhaled and exhaled gas flows 108 through the cartomizer 113 and through mouthpiece 501. A side inlet 504, which is protected by a valve 506 admits a supplemental air stream. In alternative embodiments, there may be a single side inlet 504 or there may be multiple side inlets 504. The supplemental air stream through the side inlet 504 may not enter the cartomizer 113, but flows along the wall 503 externally to the cartomizer 113, passing over or near the flavor enhancement element(s) 502. The flavor enhancement elements 502 release flavoring agent, which combines with the supplemental air stream. The supplemental air stream (with enhanced flavoring agent) combines with the main air stream 108 proximal to the cartomizer 113, and both streams are drawn in by the user. During exhalation the valve 506 closes, preventing egress of air through the inlet 504.

Figure 6:
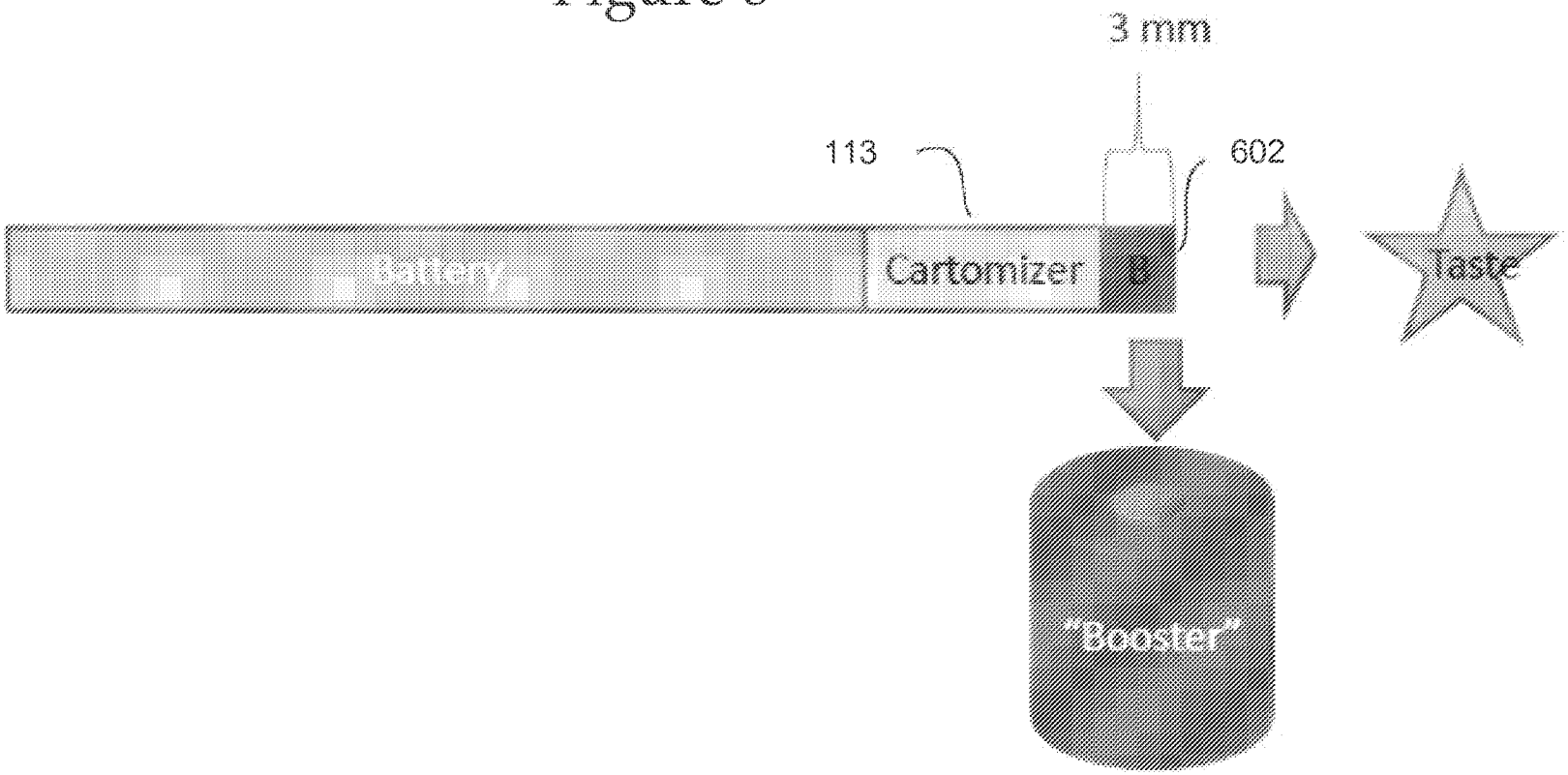
FIG. 6 is a first exemplary booster embodiment for flavor enhancement.

FIG. 6 is a first exemplary booster embodiment for flavor enhancement. A flavor booster 602 is added to the e-Cig adjacent the cartomizer 113. The booster may be made of the same material as the shell, and may include the flavor enhancing elements described with respect to either the sticker or shell. The flavor booster 602 does not surround the cartomizer 113 and the main air flow through the cartomizer 113 also flows through the flavor booster 602. In one embodiment, the flavor booster 602 is a mouthpiece extension is added to the exterior of the cartomizer and becomes a point of contact with the lips of the smoker. This variant further enhances the flavor as experienced by the smoker. The flavor booster 602 may be fitted, or screwed into the proximal end of the cartomizer 113. It may be about 3 mm in length, and may contact the lips or tongue of the smoker, where the contact causes the flavor to be sensed with greater intensity. The flavor booster 602 may be constructed as described in the shells of the previous embodiments.

There may be a special external (removable) wrap or container or packaging for the flavor booster 602 or for the cartridge that will seal in and preserve the flavor during storage or between uses. It may insulate against heat, light, moisture, or oxygen, etc. The booster 602 may be filled with powder or liquid or solid crystal or gum that will be released into the mouth before, during, or after e-Cig usage. The release of the booster 602 contents may be activated by licking away the external layer, squeezing with the teeth or biting the booster to rupture it, or biting into the booster itself and chewing it.

Figure 7:
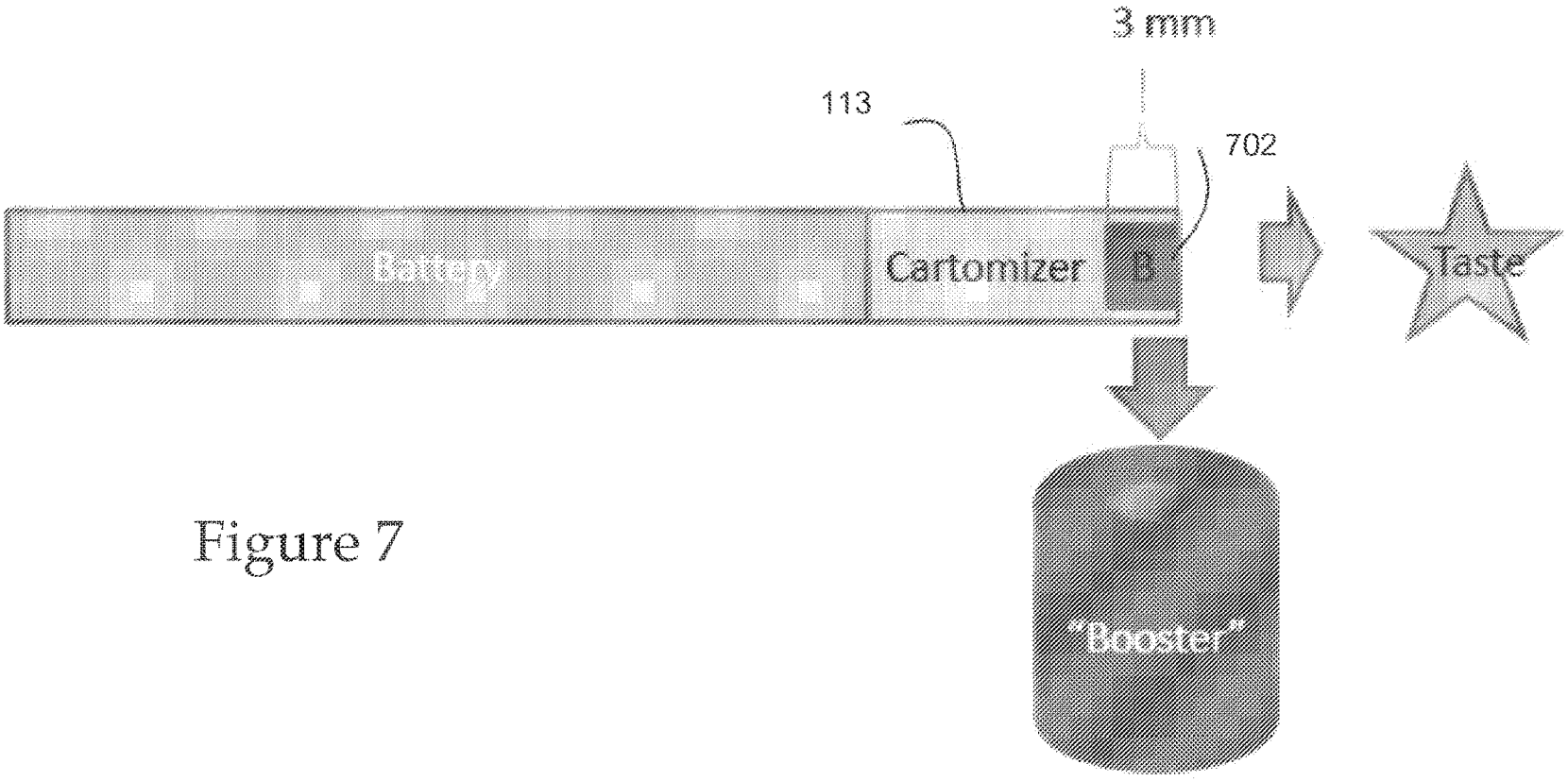
FIG. 7 is a second exemplary booster embodiment for flavor enhancement.

FIG. 7 is a second exemplary booster embodiment for flavor enhancement. The flavor booster 702 in FIG. 7 is illustrated as part of the cartomizer 113 rather than as a separate component as in FIG. 6. The flavor booster 702 may be one of the shells described above. The flavor booster 702 is inset in the proximal end of the cartomizer 113, for example by press fitting, or screwing. A locking mechanism (not shown) as described above may retain the flavor booster 702, and be unlocked in order to permit replacement of the flavor booster 702. The flavor booster 702 may have a length of about 3 mm. However, this dimension may be adjusted to vary the effect of the flavoring agent. The flavoring agent mixes with the inhaled fumes and changes the olfactory experience. In addition, taste enhancement is available, as the smoker's tongue can contact the end of the flavor booster 702.

FIG. 8 is an exemplary mouthpiece embodiment for flavor enhancement. The cartomizer 113 may be coupled with a removable mouthpiece 802. The mouthpiece 802 may attach to the cartomizer 113 and provide flavor enhancement as described above.

FIG. 9 is an exploded view of an exemplary mouthpiece embodiment for flavor enhancement. A chamber 904 is formed in the mouthpiece 802 as shown, and is filled with a flavoring agent. In one embodiment, the flavoring agent may be a sweet substance, such as candy. The flavoring agent may include an artificial sweetener or sugar that provides a pleasing taste to the user. Caffeine may be added to create additional effect to the nicotine or other e-liquids in the e-Cig. Other flavors may be used. When the flavoring element is a candy, the candy should pass appropriate industrial tests as known in the candy industry and it should possess suitable enable mechanical properties that will enable the candy to be kept in place and as one piece until completely eaten.

The mouthpiece 802 may be made of plastic with a recess 906 formed therein such that its inner diameter fits over the cartomizer 113 and enables fast mounting and dismounting from the cartomizer 113. It should be flexible enough to create a firm hold on the cartomizer 113 to enable use of the e-Cig without being dislodged. In the mouthpiece 802 there may be an internal bore 908 for passage of vapor/mist from the cartomizer 113 to enable vaping through the mouthpiece with minimal drag to air flow (e.g. a hole with a diameter of 2-3 mm may be suitable).

FIG. 10 is an alternative exemplary mouthpiece embodiment for flavor enhancement. Near the contact point between the bore 908 and the cartomizer 113 may a valve 1006 that will enable a flow of fluid from the mouthpiece to the user that may enforce a one way flow through the e-Cig. This may reduce oxidation.

In an alternate embodiment, the wick and/or the heating element may also include a flavoring agent. The flavoring agent may also include a scent component. The flavoring agent may be activated by heat and result in improved flavor and/or scent for the user. In particular, the first few puffs of the e-Cig may be improved by the flavor agent or scent agent from the heating element and/or wick being activated which may overcome any initial burning smell. In addition, other components of the e-Cig may also include or be coated with a flavoring agent or scent agent as described in the embodiments above. The additional flavoring/scent agent may provide a pleasant flavor/scent to the user to improve the e-Cig experience. In another embodiment, a package of the e-Cig or a package of cartridges or cartomizers may also include a scent agent that reveals the scent or suggests the flavor of the particular product. For example, a box of cartomizers with mint flavored e-liquid may have a mint scent agent so that the box smells like mint. Likewise, the enhanced flavoring embodiments described above may also be previewed from the box.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art, which would occur to persons skilled in the art upon reading the foregoing description.

We claim:

1. A cartridge assembly for coupling to a battery portion of an electronic vaping device, the cartridge assembly comprising:

a cartridge portion, the cartridge portion being configured to generate a dispersion that is added to air flow through the cartridge, the cartridge portion including a heating coil wrapped around a wick, the cartridge portion including an airflow tube and an outer housing, the cartridge portion being filled with a liquid; and a mouthpiece connected to the cartridge portion, the mouthpiece being attached to an outer surface of the cartridge portion, and an end region of the cartridge portion extending into the mouthpiece such that the mouthpiece surrounds at least a portion of the end region of the cartridge portion.

2. The cartridge assembly of claim 1, wherein the mouthpiece is removable from the cartridge portion.

3. The cartridge assembly of claim 1, wherein the liquid includes one or more flavors.

4. The cartridge assembly of claim 3, wherein the one or more flavors include mint.

5. The cartridge assembly of claim 1, wherein the liquid includes glycerin and propylene glycol.

6. The cartridge assembly of claim 1, wherein the liquid has a tobacco fragrance.

7. The cartridge assembly of claim 1, wherein the liquid includes menthol.

8. The cartridge assembly of claim 1, wherein the airflow tube extends through a central region of the cartridge.

9. The cartridge assembly of claim 1, wherein the airflow tube has a cylindrical shape.

10. A cartridge assembly for coupling to a battery portion of an electronic vaping device, the cartridge assembly comprising:

a housing, the housing including an end region;

an airflow tube in the housing;

a wick in the housing;

a liquid in the housing, a portion of the liquid on the wick, a heating coil in the housing, the heating coil wrapped around the wick, the heating coil for heating the portion of liquid on the wick to generate a dispersion that is added to air flow through the cartridge; and a mouthpiece connected to the housing, the mouthpiece being attached to an outer surface of the housing, and the end region of the housing extending into the mouthpiece such that the mouthpiece surrounds at least a portion of the end region of the housing.

11. The cartridge assembly of claim 10, wherein the mouthpiece is removable from the housing.

12. The cartridge assembly of claim 10, wherein the liquid includes one or more flavors.

13. The cartridge assembly of claim 12, wherein the one or more flavors include mint.

14. The cartridge assembly of claim 10, wherein the liquid includes glycerin and propylene glycol.

15. The cartridge assembly of claim 10, wherein the liquid has a tobacco fragrance.

16. The cartridge assembly of claim 10, wherein the liquid includes menthol.

17. The cartridge assembly of claim 10, wherein the airflow tube extends through a central region of the housing.

18. The cartridge assembly of claim 10, wherein the airflow tube has a cylindrical shape.

* * * * *